US010446386B1

(12) United States Patent
Botero

(10) Patent No.: US 10,446,386 B1
(45) Date of Patent: Oct. 15, 2019

(54) HIGH-PRESSURE HEAT BULB

(71) Applicant: Carlos Botero, Plant City, FL (US)

(72) Inventor: Carlos Botero, Plant City, FL (US)

( * ) Notice: Subject to any disclaimer, the term of this patent is extended or adjusted under 35 U.S.C. 154(b) by 0 days.

(21) Appl. No.: 15/650,961

(22) Filed: Jul. 16, 2017

(51) Int. Cl.

| | |
|---|---|
| ***H01J 61/36*** | (2006.01) |
| ***F24H 1/00*** | (2006.01) |
| ***H01J 61/52*** | (2006.01) |
| ***H01J 61/30*** | (2006.01) |
| ***H01J 5/03*** | (2006.01) |
| ***F24H 9/00*** | (2006.01) |

(52) U.S. Cl.
CPC ..... *H01J 61/523* (2013.01); *F24H 9/0005* (2013.01); *H01J 5/03* (2013.01); *H01J 61/302* (2013.01)

(58) Field of Classification Search
CPC ..... H01J 61/523; H01J 61/302; F29H 9/0005; F24H 2250/14; F24H 1/142; F24H 1/162
USPC ..... 313/568
See application file for complete search history.

(56) References Cited

U.S. PATENT DOCUMENTS

| | | | | |
|---|---|---|---|---|
| 3,956,611 | A * | 5/1976 | Nakamura | H05B 7/225 219/405 |
| 5,038,395 | A * | 8/1991 | Lenski | C30B 13/24 219/405 |
| 5,404,078 | A * | 4/1995 | Bunk | H01J 9/323 313/623 |
| 2006/0279218 | A1* | 12/2006 | Uemura | H01J 9/323 313/636 |
| 2011/0008028 | A1* | 1/2011 | Maeda | F24H 1/101 392/416 |
| 2011/0058797 | A1* | 3/2011 | Servidio | F24D 11/002 392/411 |
| 2012/0063754 | A1* | 3/2012 | Nishida | F24H 1/162 392/424 |

* cited by examiner

*Primary Examiner* — Christopher M Raabe
(74) *Attorney, Agent, or Firm* — Edwin D. Schindler

(57) ABSTRACT

A heating bulb for a liquid boiler includes a metal pressure shell of titanium or the like and contains an inner pressure plenum that stores pressurized inert gas, such as argon. The inner pressure plenum is sealed with a ceramic isolation plug that also contains a power conduit supplying a resistance heating element within the inner pressure plenum. Preferably, from approximately five to 100 atmospheres of pressure may be used to make the heating of the pressurized inert gas more efficient for heating a liquid within a boiler into which the heating bulb is placed. Thermocouples are used to control the flow of power to the resistance heating element.

8 Claims, 2 Drawing Sheets

HIGH-PRESSURE HEAT BULB

BACKGROUND OF THE INVENTION

Technical Field of the Invention

Figure 1:
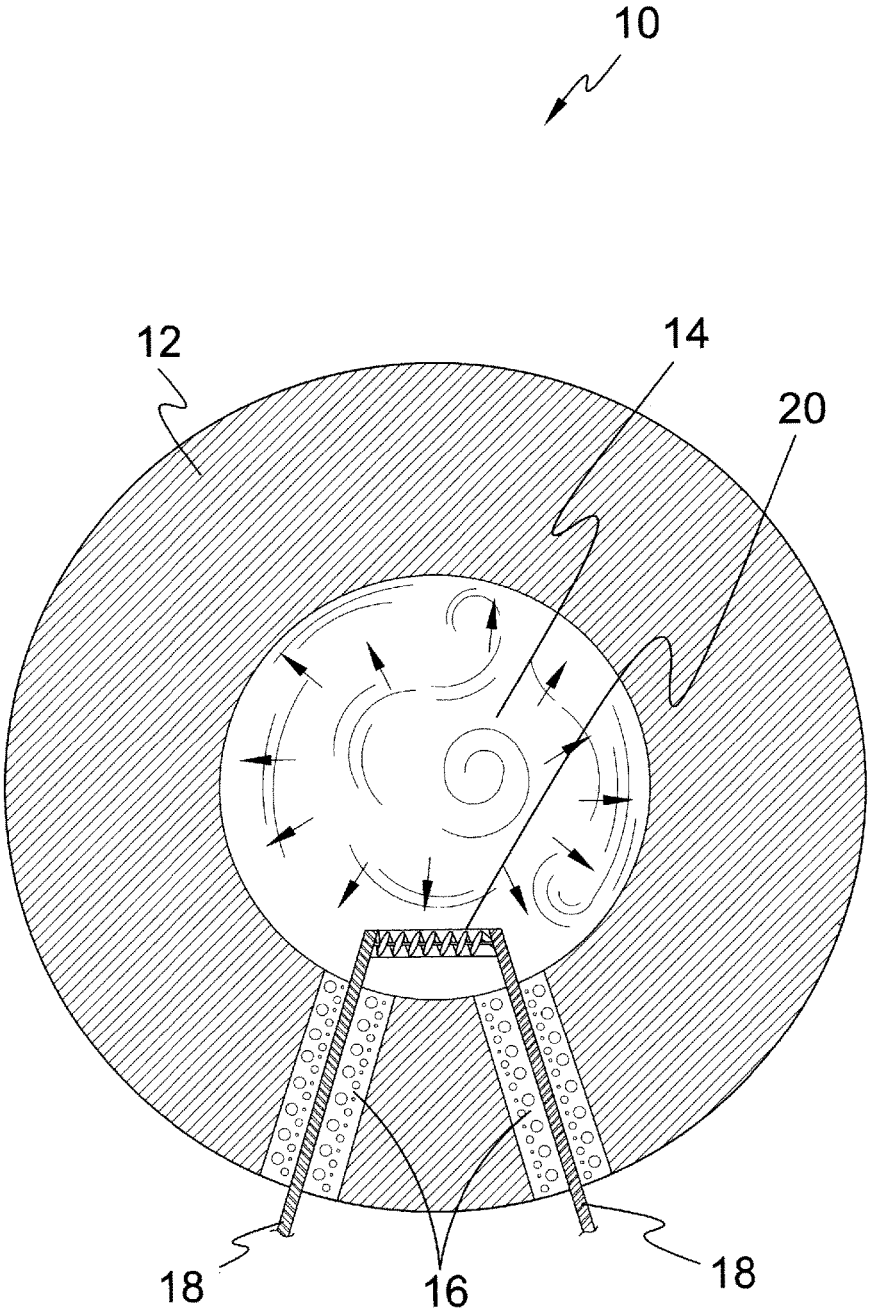

The present invention relates, generally, to heating units and, more particularly, the present invention relates to a heating unit adapted to use resistance heat to increase the temperature of a pressurized inert gas and, further, the present invention pertains to the heated pressurized gas being present in a hard metal sphere made of titanium or the like.

The present invention may be used to heat water in boilers of varying sizes.

Description of the Prior Art

There are other heating arrangements for boilers generally known in the prior art. While these devices may be suitable for the purposes for which they where designed, they would not be as suitable for the purposes of the present invention as heretofore described.

In contrast to the prior art, the present invention, as described herein, allows for a more efficient heating of large quantities of liquids using resistance elements as the heat source. Additionally, the present invention differs from the prior art by allowing for the pressurized bulb to be sealed with a heat and pressure resistant ceramic material.

SUMMARY OF THE INVENTION

A primary object of the present invention is to provide a heating bulb for a boiler or the like that utilizes pressurized inert gas.

Another object of the present invention is to provide a heating bulb for a boiler wherein the pressurized inert gas is sealed into a hard metal container/bulb made of titanium or a similar metal.

Yet another object of the present invention is to provide a heating bulb for a boiler where the pressurized inert gas is sealed within the container/bulb with a pressure and temperature resistant ceramic.

Still yet another object of the present invention is to provide a heating bulb for a boiler wherein the pressurized inert gas is heated by electric resistance.

Additional objects of the present invention will appear as the description proceeds.

The present invention overcomes the shortcomings of the prior art by providing an efficient boiler heating element that can be used with a variety of electrical power sources, including solar.

More particularly, the present invention provides a heat bulb for a liquid boiler, which includes a metal pressure shell having an interior pressure plenum, a ceramic isolation plug to seal the interior pressure plenum and a power conduit located within, and passing through, the ceramic isolation plug. A resistance heating element is connected to the power conduit with the resistance heating element being located within the interior pressure plenum, wherein an inert gas is pressurized and introduced into the interior pressure plenum and power is supplied via the power conduit to the resistance heating element for heating the pressurized gas in the interior pressure plenum and there-by for heating a liquid located in the liquid boiler by increasing the temperature of the heat bulb and therefore the liquid in the boiler.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

Figure 2:
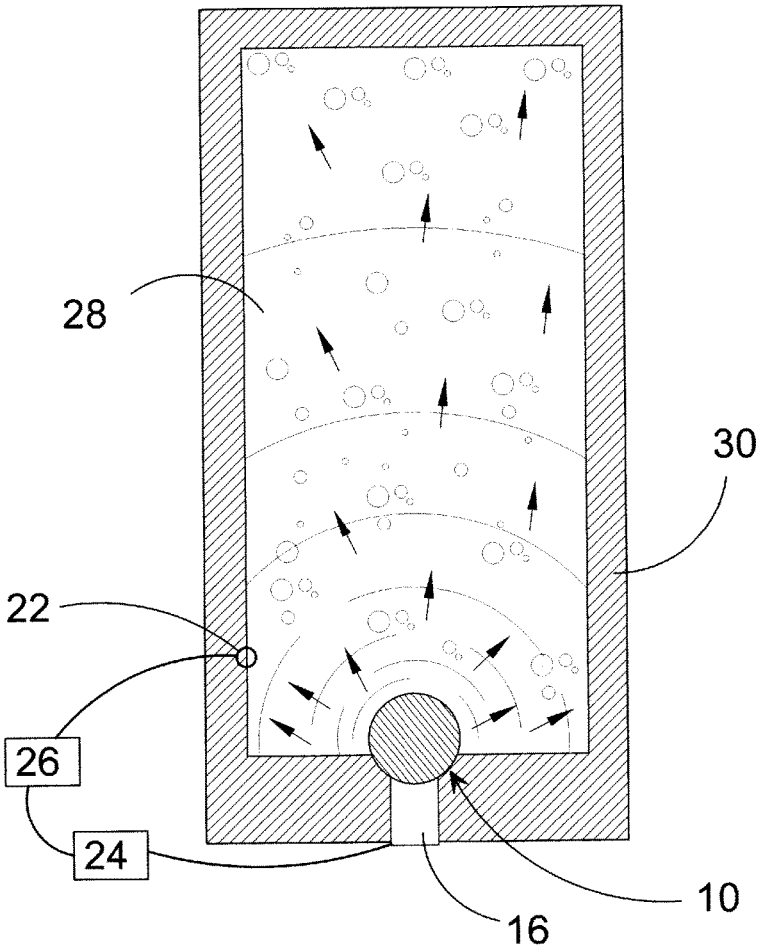

In the drawing figures, wherein similar features are denoted with similar reference numerals throughout the several views:

FIG. 1 is a side cutaway view of the heat bulb of the present invention; and, FIG. 2 is an orthographic view of the heat bulb of the present invention in use heating liquid in a containment tank.

DESCRIPTION OF THE REFERENCED NUMERALS

Turning now descriptively to the drawings, in which similar reference characters denote similar elements throughout the several views, the figures illustrate the use of the present invention. With regard to the reference numerals used, the following numbering is used throughout the various drawing figures:

10 present invention
12 metal pressure sphere
14 pressurized inert gas
16 ceramic isolation plug
18 current supply conduit
20 resistance heating element
22 thermocouple
24 power supply
26 thermocouple control
28 boiler liquid
30 boiler

DETAILED DESCRIPTION OF THE DRAWING FIGURES AND PREFERRED EMBODIMENTS

Referring to FIG. 1, the present invention is generally indicated by reference numeral 10. The invention comprises a metal pressure sphere 12 containing pressurized inert gas designed by reference numeral 14. The gas 14 is held within the sphere 12 with the ceramic isolation plug 16 that holds the current supply (wires or the like) indicated by reference numeral 18. The current supplies the resistance heating element 20. In the embodiment contemplated herein, the metal pressure sphere 12 would preferably be made of some very durable metal, such as, e.g., titanium. Various inert gasses could be used at the point designed by reference numeral 14 however argon and helium are preferred. The ceramic isolation plug 16 could be made of an almunina oxide ceramic, known for high temperature and pressure capability. The power supply wires 18 would be connected to the resistance heating element 20 located in the pressurized inert gas 14. This resistance heating element 20 could be a tungsten element or similar type element. The inert pressurized gas 14 could be created at a predetermined pressure in regards to how hot the bulb 10 of the present invention needs to be. Five to 200 atmospheres is contemplated to allow the pressurized gas 14 to reach very high temperatures with a smaller power supply.

Turning to FIG. 2, the present invention 10 is seen in use heating the liquid 28 in the boiler 30. It should be understood that though water is the liquid most commonly used, other liquids could be used. The bulb 10 is connected to a power supply 24. This power supply 24 could be household current (110 or 220V in the United States) or it could be similar to a solar array. A thermocouple 22 and a thermocouple control 26 supply power, as needed, to the resistance heating element 20 through the power conduits 18. Using a power supply such as solar array, is very effective with the present invention 10 as the pressurized gas 14 may be raised to a very high temperature more efficiently.

While only several embodiments of the present invention have been shown and described, it will be obvious to those skilled in the art that many modifications may be made to the present invention without departing from the spirit and scope thereof.

What is claimed is:

1. A heat bulb in combination with a liquid boiler, comprising:

a liquid boiler for heating a liquid therein;

a metal pressure shell having an interior pressure plenum;

a ceramic isolation plug to seal said interior pressure plenum;

a power supply;

a power conduit located within and passing through said ceramic isolation plug for the power supply;

a resistance heating element connected to said power conduit, said resistance heating element being located within said interior pressure plenum; and, a thermocouple for controlling the power supply to said resistance heating element and for controlling temperature, the power supply providing current for yielding a voltage of either 110V or 220V; and, wherein an inert gas is pressurized and introduced into said interior pressure plenum and power is supplied via said power conduit to said resistance heating element for heating said pressurized gas in said interior pressure plenum for heating the liquid located in the liquid boiler, the liquid being in direct contact with said heat bulb for effecting heating of the liquid in the liquid boiler.

2. The heat bulb in combination with a liquid boiler as claimed in claim 1, wherein said metal pressure shell is made of titanium.

3. The heat bulb in combination with a liquid boiler as claimed in claim 1, wherein said pressurized inert gas is argon.

4. The heat bulb in combination with a liquid boiler as claimed in claim 3, wherein said inert gas is pressurized to at least three atmospheres.

5. The heat bulb in combination with a liquid boiler as claimed in claim 4, wherein said ceramic isolation plug is comprised of an alumina oxide ceramic.

6. The heat bulb in combination with a liquid boiler as claimed in claim 5, wherein said resistance heating element is a tungsten heating element.

7. The heat bulb in combination with a liquid boiler as claimed in claim 6, wherein said metal pressure shell is made of titanium.

8. The heat bulb in combination with a liquid boiler, wherein said power supply includes a solar array.

* * * * *